US005463892A

United States Patent [19]

Nakagawa

[11] Patent Number: 5,463,892

[45] Date of Patent: Nov. 7, 1995

[54] HYDRAULIC PRESS

[75] Inventor: Masao Nakagawa, Okazaki, Japan

[73] Assignee: Nisshinbo Industries, Inc., Tokyo, Japan

[21] Appl. No.: 213,571

[22] Filed: Mar. 16, 1994

[30] Foreign Application Priority Data

Mar. 18, 1993 [JP] Japan ..... 5-058215

[51] Int. Cl.[6] ..... B21J 9/12; B21J 13/04; B21D 37/04

[52] U.S. Cl. ..... 72/456; 72/416; 72/453.15

[58] Field of Search ..... 72/401, 402, 416, 72/453.15, 453.16, 455, 456

[56] References Cited

U.S. PATENT DOCUMENTS

| | | | |
|---|---|---|---|
| 676,292 | 6/1901 | Wigtel | 72/453.16 |
| 2,030,803 | 2/1936 | Temple, Jr. | 72/416 |
| 2,533,943 | 12/1950 | Klein | 72/456 |
| 2,940,497 | 6/1960 | Herrstrum . | |

FOREIGN PATENT DOCUMENTS

| | | |
|---|---|---|
| 1427394 | 10/1968 | Germany . |
| 1502157 | 3/1969 | Germany . |
| 2638245 | 3/1977 | Germany . |

OTHER PUBLICATIONS

By K. Schimz, "Das Kalteinsenken von Werkzeugen", Werkstatt und Betrieb, 1954, Heft 6, pp. 295–297.

*Primary Examiner*—David Jones
*Attorney, Agent, or Firm*—Young & Thompson

[57] ABSTRACT

A hydraulic press comprising a hydraulic cylinder including a cylinder tube and a piston slidable within the cylinder tube and having a piston rod extending from the piston and adapted for actuating a movable die of a metallic mold including a stationary die cooperating with the movable die. The cylinder tube (11) of the hydraulic cylinder (10) is extended beyond the piston rod (14) and secured at its extended end to a base plate (15), and an extended portion of the cylinder tube is provided with at least one opening (16) for inserting the metal mold (9) in a space (19) within the extended portion (20) of the cylinder tube (11) to set the movable die (a) on the end of the piston rod (14) and the stationary die (9b) on the base plate (15) and thereby to reduce weight and manufacturing cost of the hydraulic press having a high strength against eccentric load and further to provide an improved hydraulic press easily changeable in its layout.

2 Claims, 2 Drawing Sheets

HYDRAULIC PRESS

BACKGROUND OF THE INVENTION

The present invention relates to a hydraulic press such as a cold forging press, a plastic forming press and the like comprising a hydraulic cylinder for driving a movable die of a metal mold which has a molding area smaller than an end surface area of a piston of the hydraulic cylinder so that a pressing force of the hydraulic cylinder is concentrated in the small molding area of the mold to press a workpiece under a high pressure.

A conventional example of such a hydraulic press is illustrated in FIG. 1. This conventional hydraulic press comprises a portal frame 1, a hydraulic cylinder 4 and a metal mold 9. The metal mold 9 shown in FIG. 1 has a molding area A smaller than an end surface area B of a piston of the hydraulic cylinder so that a pressing force of the hydraulic cylinder is concentrated in the small molding area of the metal mold to press a workpiece under a high pressure.

It is noted from FIG. 1 that the portal frame 1 is composed of a bed 1*a*, columns 1*b* standing at opposite sides on the bed 1*a*, and a crown 1*c* extending over the columns 1*b*. Each of the columns 1*b* is integrally connected to the bed 1*a* and crown 1*c* by means of tie rods 2 and nuts 3 fastened to upper ends of the tie rods.

The hydraulic cylinder 4 has a cylinder tube 4*a* fitted in a through hole formed in the central portion of the crown 1*c*, and a piston 4*b* slidably fitted in the cylindrical bore of the cylinder tube 4*a*. The piston 4*b* has a piston rod 4*c* which is extended out of the cylinder tube 4*a* through a cylinder lid 4*d* fixed to the open end of the cylinder tube. The reference numeral 5 denotes an O-ring interposed between the end of the cylinder tube 4*a* and the lid 4*d*, 6 oil seals on the piston 4*b* and 7 an oil seal in the cylinder lid 4*d*.

The piston rod 4*c* is connected at its extended lower end to a slider 8 which has long sliding side surfaces in order to resist an eccentric load. The sliding side surfaces slidably contact opposite gibs 1*d* and 1*d* secured to the side columns 1*b* and 1*b*, respectively.

The metal mold 9 is composed of an upper forming die 9*a* secured to the lower end of the slider 8 and a lower molding die 9*b* fixedly mounted on the bed 1*a* of the frame 1. The molding area (A) of the mold 9 is defined by areas of horizontal surfaces of the upper or lower molding die and greatly smaller than the area (B) of the top end surface of the piston 4*b*.

The conventional hydraulic press adapted for supporting a high press forming pressure occurring between the dies 9*a* and 9*b* during die forming by rigidity of the frame 1 of the hydraulic press is designed to support a reaction of the press forming pressure. This is the feature of the hydraulic press most different from hammer machines, the conventional hydraulic press of high pressure type generally has substantially the same construction as that of a generic type press, but the more the reaction increases the more the frame constituting member becomes large since the great reaction must be supported by the frame 1.

The frame 1 of the conventional hydraulic press shown in FIG. 1 seems too large for the small metal mold 9*a*, 9*b*. In the cold forging press, however, a high pressing pressure is required for press forming a small workpiece. For example, a compression force of more than 1,000 tons is required for press forming a 100 mm-diameter steel sheet so that a hydraulic cylinder having about one meter in diameter is required. Accordingly, a hydraulic press using a square metal mold 300 mm in each side length becomes incongruously large. Thus, a specification of the press is not dependent on a size of the metal mold to be used, but in the case shown in FIG. 1, is dependent on a dimension which the hydraulic cylinder 4 and the tie rod nut 3 do not interface. As mentioned above, the conventional hydraulic press is constructed for convenience of the maker rather than the user. However, it is no good that the metal mold securing surface is unnecessarily large since mechanical strength of the press is largely affected. That is, the supporting points are located far from the load as shown in FIG. 1 so that the frame 1 is largely deformed. In order to prevent such a deformation of the frame, it is necessary to increase the rigidity of the frame. Accordingly, in view of the required rigidity mentioned above, conventional hydraulic presses having a capacity more than one thousand tons could not be manufactured it low cost.

SUMMARY OF THE INVENTION

It is an object of the invention to reduce weight and manufacturing cost of the hydraulic press having a high strength against eccentric load.

According to the present invention, in a hydraulic press comprising a hydraulic cylinder for driving a movable die of a metal mold, a cylinder tube of the hydraulic cylinder is extended beyond a piston rod and secured at its extended end to a base plate for locking a stationary die of the metal mold, and an extended portion of the cylinder tube is provided with an opening for inserting the molding dies in a space within the extended portion of the cylinder tube to set the movable die and stationary die on the end of a piston rod and the base plate, respectively.

According to the present invention, the reaction of the pressing pressure is supported by the cylinder tube of the hydraulic cylinder so that the large portal frame provided in the conventional hydraulic press can be omitted. Thus, the present hydraulic press can be greatly lightened and its manufacturing cost is greatly reduced.

Furthermore, since the hydraulic press can be made in a small size as the whole, the layout of the hydraulic press can be optionally changed. The hydraulic press of the present invention has various advantages that the number of components is a few, high accuracy is easily attained and clearance between components can be limited so that a very strong structure against eccentric load is obtained.

The invention will be more fully understood by referring to the following detailed specification and the accompanying drawings.

BRIEF DESCRIPTION OF THE DRAWINGS

Referring to FIGS. 2 and 3 illustrating an embodiment of the present invention, a hydraulic cylinder 10 is composed of a cylinder tube 11, a cap 12 fixed to an upper end of the cylinder tube 11 through a seal ring 5, a piston 13 slidably fitted in a cylinder bore 17 of circular section and provided with oil seal rings 6 as usual, and a piston rod 14 extending from the piston 13 in a piston rod guide bore 18. The cylinder tube 11 is extended beyond the piston rod 14 to provide a mold setting space 19 within an extended portion 20 of the cylinder tube 11.

Figure 1:
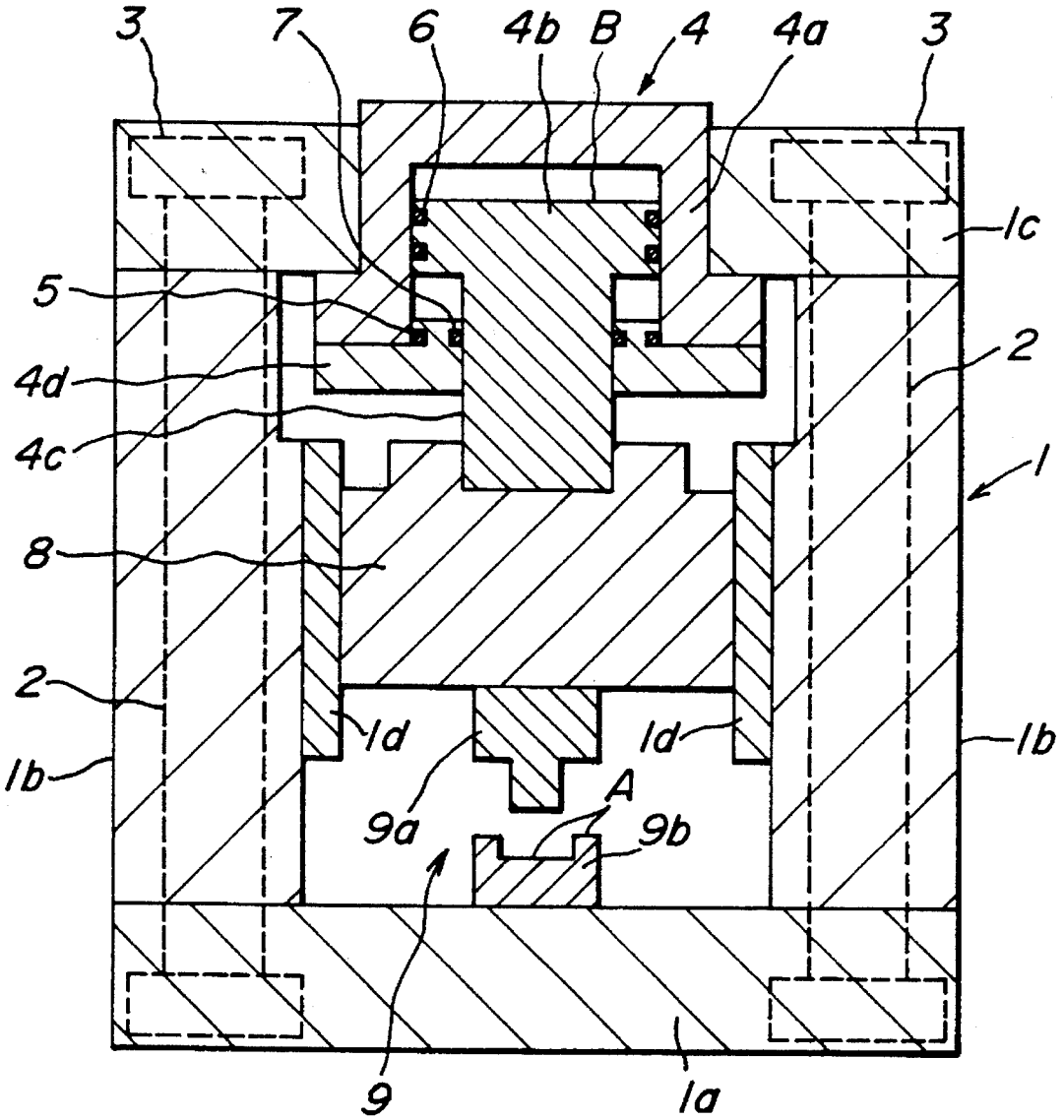
FIG. 1 is a vertical sectional view of a conventional hydraulic press.
Figure 2:
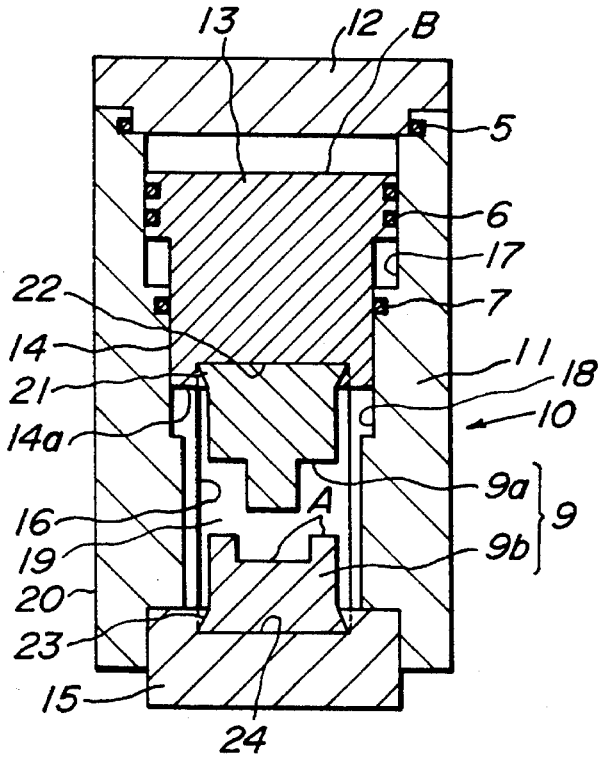
FIG. 2 is a vertical sectional view of an embodiment of a hydraulic press according to the invention.

In the present embodiment, the metal mold 9 is set in a mold setting space 19 within an extended portion 20 of the cylinder tube 11 extended beyond the piston rod 14. The metal mold 9 includes the upper movable die 9*a* which is locked to the lower end 14*a* of the piston rod 14 and a lower stational die 9*b* which is locked to a base plate 15 integrally secured to the lower end of the cylinder tube 11. The extended portion 20 of the cylinder tube 11 is provided with a side opening 16 to permit setting of the mold in the mold setting space 19 within the extended portion 20 of the cylinder tube 11.

The metal mold 9 may be set in the predetermined position in such a manner that the upper movable die 9*a* is inserted into the mold setting space 19 through the side opening 16 by sliding a dovetail 21 formed at the upper fixing end of the upper movable die 9*a* into a dovetail tenon 22 formed in the lower end of the piston rod 14 from an open end of the tenon until the dovetail 21 contacts an inner closed end of the tenon 22 and then locked to the piston rod 14 by means of bolts, latch or the like, while the lower stationary die 9*b* is also inserted into the mold setting space 19 through the side opening 16 by sliding a dovetail 23 formed at the lower fixing end of the lower stationary die 9*b* into a dovetail tenon 24 formed in the base plate 15 from an open end of the tenon until the dovetail 23 contacts an inner closed end of the tenon 24 and then locked to the base plate by means of bolts, latch or the like.

Figure 3:
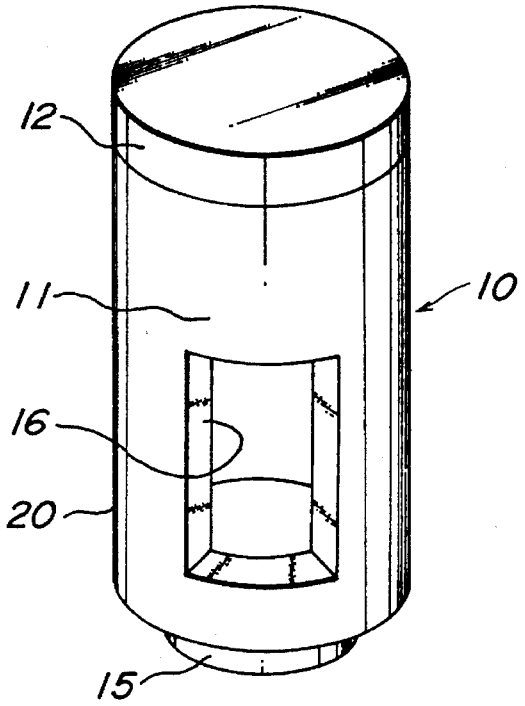
FIG. 3 is a perspective view of the hydraulic press shown in FIG. 2.

As described above, according to the present invention, since the reaction of the pressing pressure is supported by the cylinder tube 11 of the hydraulic cylinder 10, it is necessary to reinforce peripheral portions about the opening 16 which are weak in strength, but the remaining portions of the cylinder tube can be made to have a sufficient rigidity to support the reaction. The cylinder tube 11 contacts and guides the whole outer periphery of the piston 13 including the piston rod to thereby resist the eccentric load. The cylinder tube 11 in the embodiment shown in FIG. 3 is circular cylindrical, but a square tube or the like having a circular cylindrical inner bore may be used in order to effect easily the layout of the hydraulic press.

As aforementioned, according to the present invention, the cylinder 10 can effectively support the reaction of the press forming pressure and therefore the great portal frame is unnecessary. Accordingly, weight and cost of the hydraulic press can be greatly reduced.

As the result of trial cost accounting, a great cost decrease is expected, and the weight and cost of the press are reduced to one-third to one-fourth of the conventional press having a corresponding capacity. This comparative trial accounting was applied for a cold forging press with 300 mm square metal mold and having a capacity of 1,000 ton. While in the prior system, a large press having a 1,000 mm square metal mold is used, in such a large press differences of weight and cost greately increase. Since such a great cost decrease is expected, the hydraulic press according to the present invention can be applied for various cold forging in cases where a hydraulic press could not be used economically.

The hydraulic press can be provided in small size. That is, the area of the press base of the invention can be reduced to one-fourth that of the conventional press and the height of the press can be reduce to one-half that of the conventional press. Therefore, the hydraulic press of the invention can be arranged in any places along an assembly line which have not been considered as a desirable location. The bulk of the press is small to be not required to embed its lower portion under the ground so that the layout of the press can be freely changed.

The hydraulic press according to the present invention guides the movement of the movable molding die on the inside surface of cylinder tube of the hydraulic cylinder and lubricates a clearance of one-fifth that of the conventional press with lubricant which is forcedly supplied. Accordingly the present hydraulic press is highly accurate when stationary, and strongly and effectively supports the eccentric load caused by various workpieces.

I claim:

1. In a hydraulic press comprising a hydraulic cylinder including a cylinder tube and a piston slidable within the cylinder tube and having a piston rod extending from the piston and adapted for actuating a movable die of a metallic mold, said mold including a stationary die cooperating with the movable die, said cylinder tube extending beyond the piston rod and being secured at one end to a base place, and an extended portion of the cylinder tube being provided with an opening for inserting the metal mold within the cylinder tube to set the movable die on an end of the piston rod and the stationary die on the base plate; the improvement wherein the movable die has a dovetail connection with said end of said piston and the stationary die has a dovetail connection with said base plate, said dovetail connections being so oriented relative to said opening that said stationary and movable dies are emplaceable within and removable form the cylinder tube by sliding movement along said dovetail connections into and out of said opening.

2. The hydraulic press claimed in claim 1, wherein the piston rod is in slidable contact with an inner wall of the cylinder tube.

* * * * *